US006643963B2

(12) United States Patent
Beller

(10) Patent No.: US 6,643,963 B2
(45) Date of Patent: Nov. 11, 2003

(54) TRAILING SIGN SUPPORT SYSTEM

(76) Inventor: Stuart J. Beller, 28 Lorin Bee Dr., Westerlo, NY (US) 12193

( * ) Notice: Subject to any disclaimer, the term of this patent is extended or adjusted under 35 U.S.C. 154(b) by 58 days.

(21) Appl. No.: 09/826,761

(22) Filed: Apr. 5, 2001

(65) Prior Publication Data

US 2002/0144443 A1 Oct. 10, 2002

(51) Int. Cl.[7] ..... G09F 21/04
(52) U.S. Cl. ..... 40/590; 40/591
(58) Field of Search ..... 40/590, 591, 556, 40/541, 606, 592, 660, 764, 757–759; 340/431, 473; 296/21; 224/519–521; D12/162

(56) References Cited

U.S. PATENT DOCUMENTS

| | | | | | |
|---|---|---|---|---|---|
| 2,238,875 | A | * | 4/1941 | Manson | 273/360 |
| 3,702,033 | A | * | 11/1972 | Coleman | 280/415.1 |
| 3,798,814 | A | * | 3/1974 | Harmon | 116/63 P |
| 4,084,338 | A | * | 4/1978 | Ross | 40/592 |
| 4,787,163 | A | * | 11/1988 | Berg | 40/464 |
| 4,805,331 | A | * | 2/1989 | Boggess et al. | 40/651 |
| 4,881,707 | A | * | 11/1989 | Garfinkle | 248/222.12 |
| 4,909,464 | A | * | 3/1990 | Levine et al. | 248/220.22 |
| 5,005,893 | A | * | 4/1991 | McCrary | 296/181 |
| 5,233,773 | A | * | 8/1993 | Reynolds | 40/661.03 |
| 5,289,652 | A | * | 3/1994 | Kringel et al. | 40/651 |
| 5,979,094 | A | | 11/1999 | Brafford, Jr. | |
| 5,996,869 | A | * | 12/1999 | Belinky et al. | 224/510 |
| 6,007,033 | A | * | 12/1999 | Casson et al. | 248/224.7 |
| 6,036,250 | A | * | 3/2000 | Glatter | 296/181 |
| 6,079,136 | A | * | 6/2000 | Kozlarek | 40/541 |
| 6,119,384 | A | * | 9/2000 | Fischer | 40/590 |
| 6,354,546 | B1 | * | 3/2002 | Mueller | 248/220.42 |
| 6,357,899 | B1 | * | 3/2002 | Craven | 362/485 |
| D464,919 | S | * | 10/2002 | Pichan | D12/162 |
| D471,137 | S | * | 3/2003 | Shepherd et al. | D12/162 |

FOREIGN PATENT DOCUMENTS

WO WO 02/28670 * 4/2002

OTHER PUBLICATIONS

Catalog pages(on 4); Putnam Hitch Products, Inc., re: Trailer Hitch Products (Pit Crew, Inc. via internet) (2000).

* cited by examiner

*Primary Examiner*—William L Miller
(74) *Attorney, Agent, or Firm*—Fredric Morelle

(57) ABSTRACT

A vehicle-mounted, rearward cantilevered frame for holding planar display material such as signs. A sign frame, having a tongue extending from a margin thereof, is made to hold planar displays and present them so that pedestrian traffic, on both sides of the bearing vehicle, may readily view the display. The tongue is made for insertion into a trailer hitch receiver, serves as a securing mount, and is the principal directional and cantilever support for the frame. Guy lines are used to support, further secure and stabilize the sign-bearing frame during vehicle movement by running them from frame tie-points to vehicle hard-points.

17 Claims, 5 Drawing Sheets

TRAILING SIGN SUPPORT SYSTEM

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates generally to vehicle-borne, advertisement support systems, and more particularly to a frame suspension and stabilization system for mounting a sign on the back end of a vehicle, such as a pickup or van. The frame, by cantilevered mounting to the vehicle, makes no contact with the ground and presents its display media off to the sides of the vehicle (hereinafter "profile" view or presentation).

2. Discussion of Relevant Art

Most vehicle-borne signs, particularly advertising apparatus, are fixed to broad, rear or side surfaces of autos, pickups or buses. Alternatively, signs are frequently attached to the roofs of motor vehicles and present profile views to the public. A profile view is much favored as it presents to a greater audience; however, if the sign is not fixed rigidly to a surface of the vehicle, as in the alternative case above, a strong frame and support means must be used to secure and stabilize the sign. This is the case even when pickups, trailers or flatbeds are the bearing vehicles. Short of towing a trailer or employing a flatbed, both wheeled devices, use of a roof-mounted or rearward-extending, framed or unframed large sign, say having dimensions greater than 2.0 ft. by 4.0 ft., has until now been ill-advised. Unless a large sign is properly mounted and stabilized, it will present a significant road or pedestrian hazard, irrespective of the bearing-vehicle's speed. Thus, there are two problems that must be solved if one wishes to avoid the "trailer" concept mentioned above: (1) the sign must be fixed to the vehicle along at least one axis, to acquire a true cantilevered posture; and (2) it must be stabilized, to avoid the "fishtailing" caused by non-laminar air flow over the sign surfaces.

Solution to the first problem, axial fixation, can be found in a device known commonly as a trailer hitch. Although many forms of equipment use or are adapted to connect to the trailer hitch, I have been able to find but one patent reference that associates it with a sign or advertising apparatus. There is disclosed, in U.S. Pat. No. 5,979,094, a trailer hitch accessory entitled: PROTECTIVE TRAILER HITCH LIGHTED SIGN. The patent shows a hitch accessory with a lighted sign, auxiliary brake lights and a protective cover for a trailer hitch. Although connectable to the hitch proper and its auxiliary electrical harness-connector, the disclosure is directed primarily to a protective hitch cover that has the additional function of signaling. The protective facility of the article is realized by the attachable cover; and the signaling feature is acquired by integration of a signaling or sign apparatus with the cover. Since the sign(a1) feature does not extend appreciably from off the rear of the bearing vehicle, the only notable deficiency, from my perspective, is that the sign faces directly to the rear of the vehicle. A rearward facing sign has minimal value for advertising purposes; while lighting a sign, irrespective of its degree of mobility, is well-known in the art.

Further to my search for relevant art, I was able to obtain, from an internet web site, two pages entitled "Trailer Hitch Products", that are provided by Putnam Hitch Products USA. Putnam products that are material to my inquiry consist of hitch-connectable frames and platforms that facilitate off-the-rear carriage for cargo support. None of the apparatus that were disclosed would suffice to support the signs of the instant invention in the required (profile) posture. Further, the supporting structures that have more than two feet of extension are adaptable, at most, for framing a rearward-facing sign.

INCORPORATION BY REFERENCE

The use of electrical auxiliary equipment in conjunction with trailer hitches is known and rather well-developed in the art; therefore, U.S. Pat. No. 5,979,094, as described above, is hereinafter incorporated by reference for its showing of lighting concepts for signs and safety features (brake lighting) used with trailer hitches.

DEFINITIONS

Wording and terms used throughout shall have their generally accepted meanings, save for the following which may connote alternative sense, absent further special definition:

- cantilever(ed) means posture(ed) to extend generally (but not necessarily) horizontally from a vehicle or other support structure;
- guy (lines) (v.) means to secure, guide or constrain, and (n./adj.) defines (cables, wires, ropes, etc.);
- hard-point(s) is/are a point(s), on a vehicle, that is integral or unitary therewith and to which a portion of the instant invention may be secured;
- hitch is a commercially-available, vehicle-borne device for receiving a trailer tongue;
- integral connotes a collection of parts, pieces, elements, etc. that form a defined unit;
- laminar means over and along the surface thereof, such as laminar air flow;
- profile, as earlier defined, means a side view, particularly to pedestrian traffic;
- shank (v.) means to tighten, cinch or shorten, e.g., a guy line, by use of a device such as a knot, turnbuckle, ratchet or similar device;
- tie-point is a point or device, that is provided for tie-down connection, or securing, of guy lines to the frame, or vehicle, and which is alternately termed hard-point for the latter;
- tongue (n.) is a part of the instant invention that is inserted into a receiver element; and,
- unitary means wholly of the same substance of manufacture and comprising a single, continuous element.

Should further special definitions be required, such will be provided parenthetically and within context.

BRIEF SUMMARY OF THE INVENTION

I have overcome deficiencies in the relevant art by providing a vehicle-mounted, rigid frame system which may be attached to the variety of vehicles that can be equipped with the common trailer hitch. The frame consists of three or four tracked rails that are end-to-end joined to form a rectilinear surround that captures a planar element, e.g., a flat panel, within its periphery. A major main element of this system is a single tongue (strut-like) projection, that extends from the lower margin, and within the plane, of the frame. The tongue may be partially inserted into a hitch, which is bolted or welded to the frame of the bearing vehicle. A portion of the tongue is adapted for secure fastening, in the hitch, by pinning or bolting with some conventional device. The primary function of this assembly is to provide a rugged, single-axis structure for maintaining both the frame's directional and cantilevered support.

Secondary support, essentially stabilizing, is provided by guying (use of cables, wires, bracing struts or straps) between at least one point, near the middle of the top margin, of the frame and at least two hard-points on the vehicle. For larger frames, for example those exceeding 1.5 m.×2.0 m. dimensions, the secondary support recommended is guying between a second tie-point, one proximate the leading edge of the frame's top margin, and the same hard-points last mentioned. Should more support be advisable, such is facilitated by guying between the first and second tie-points to other hard-points on the vehicle. A proper tensioning of the various guy lines provides an adequate degree of support and stabilization for vehicle speeds up to 50 mph.

DETAILED DESCRIPTION OF THE INVENTION

Prior to discussing the drawings, several incidentals of the invention are made known: (a) the preferred material of frame construction is steel, high-density plastic or wood, with steel being preferred; (b) the method of forming the desired frame shape, either rectangular or triangular, is preferably welding, but bolting may be used for unweldable material; and (c) structural reinforcement, if needed, is acquired by use of corner bracing which, by use of nut and bolt fixatives are used to secure the sign, irrespective of whether channeled or plain angle iron frame members are employed. For the most part, channeled or grooved frame members are used and at least a top or end margin of the frame must remain open in order to slidingly receive the planar sign into the frame. (Note: I point out that a cheaper and more expedient form of the frame element of my invention could be realized by simply forming the desired shape of welded angle iron and then bolting a "tailor-made" sign into the structure; such disclosure is made to justify the breadth of claim to the frame portion of my invention, as hereinafter made).

Figure 1:
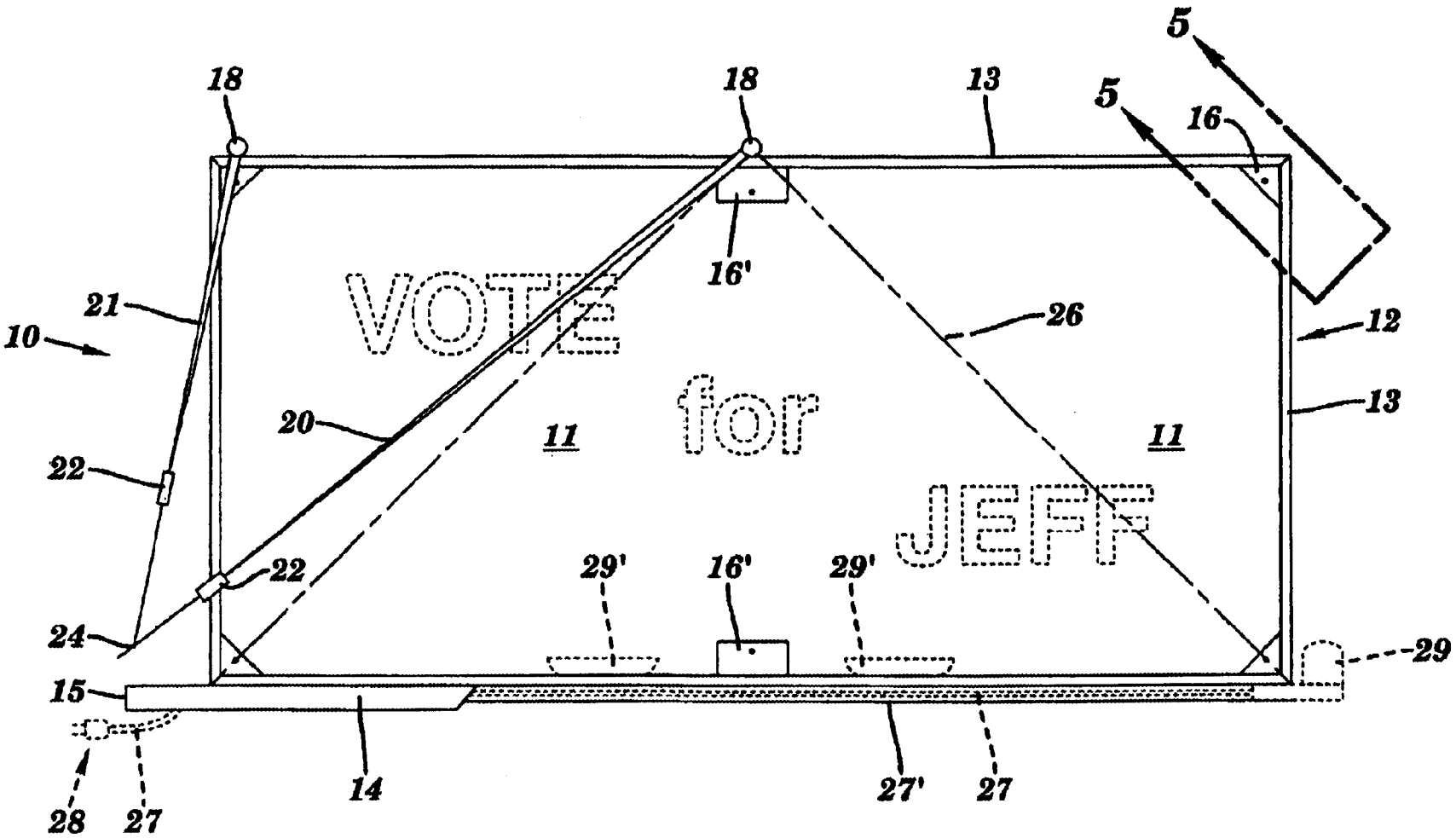
FIG. 1 illustrates the principal suspension/supporting structure of the invention.

Referring now to FIG. 1, there is shown an elevation drawing of the two constituent elements of the invention 10, namely the frame 12, consisting of three or more frame members 13, and the main support, a strut 14, that is fixedly secured to the bottom margin of the frame, and projects a portion thereof bearing a tongue feature 15. The strut provides most of the cantilever support (primary) for the frame 12, with its sign 11; any secondary support is essentially stabilizing and will be addressed below. The integrity of the frame structure 12 is generally assured by welding of the members 13; shape maintenance is well served by use of corner braces 16 which, along with brackets 16', are used to secure the sign 11. Two tie-points are featured as upward projecting D-rings 18 which, with the lines 20/21 serve to guy the frame when it is being transported or subjected to cross winds. The guy lines 20/21 are termed a secondary support means in that they play a stabilizing rather than a sustaining or foundational role. The longer guy 20 is the first secondary support and is run from the center of the top frame member (top margin) to a vehicle hard-point 42 (not yet shown). The guy is secured to a hard-point with an S-hook 24 and cinched, by a shank means 22. Depending on the type of guy used, cord, cable or strap, shank 22 may consist of a knot (sheepshank), turnbuckle or ratchet, respectively. The secondary supports are employed when frames holding signs larger than 1.5m.×2.0 m. are carried. The shorter guy 21 is termed a secondary auxiliary because it is used in addition to guy 20, and always when the larger ensemble s of quadrilateral (rectangular trapezoidal) shape; it is tied down and cinched in the same manner as the longer. Relative to diverse frame shapes 26, the triangular is shown in FIG. 1 and the trapezoidal in FIG. 2. Generally the preferred design is rectangular, but others are attainable through use of the invention's prescriptive. Final to FIG. 1, there is shown an electrical warning device 29, attached to the frame's trailing end, and sign illumination 29', both of which are provided power by way of the host vehicle (not yet shown) through electrical connector 28 and wiring 27. The wiring passes initially through a hollow strut and then under and attached to the frame member or, alternately, through conduit 27'.

Figure 2:
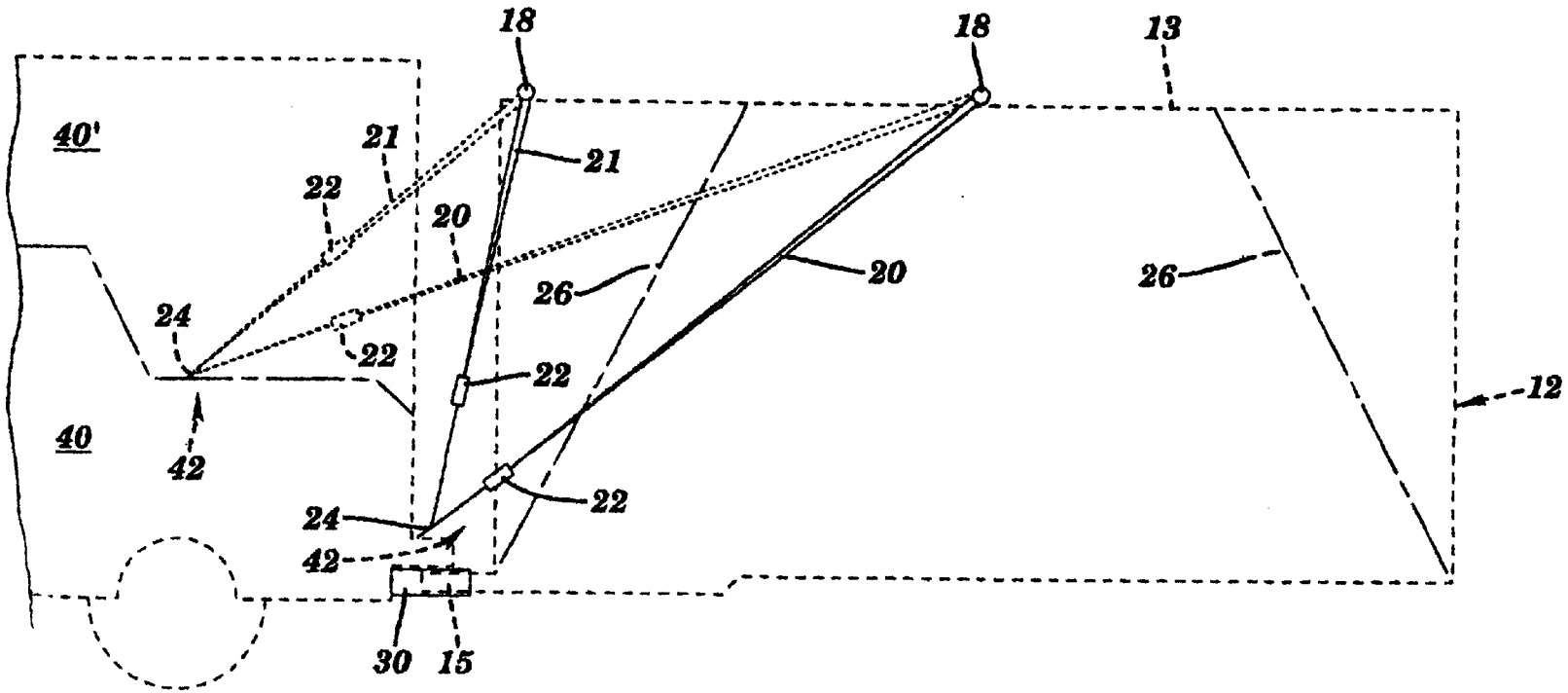
FIG. 2 depicts, in partial elevation (preponderantly in phantom) mounting of the principal supporting structure to a vehicle.

FIG. 2 illustrates, in the visible aspect, the secondary support structure (stabilizing) of the operational invention, absent any non-essentials such as electrical connections, wiring and lighting. To avoid clutter, items below 29 have been omitted, for the most part. In the invisible aspects of the figure, there are shown, in phantom, the shapes of two potential host vehicles 40/40', either of which is capable of sustaining a trailer-type hitch 30 and several hard-points 42. In each case shown, the hard-points for guy attachment are: for the upper image 40' (a truck or flatbed)—bumper, bed or side rails; and for the lower image 40 (an automobile)—bumper and trunk lid. During the initial installation, the frame, absent the sign, is generally lifted by two persons and the tongue 15 is inserted into the hitch 30. The entire invention, in the approximately 1.5 m.×2.5 m. sign that I have used, has a tongue weight of about sixty pounds. Use of secondary supports (guy lines) can relieve that load by up to 40%, with the hitch functioning as a thrust bearing. For the heavier signs, use of the automobile trunk lid as hard-point(s) is not recommended. After the frame is set, the sign may be inserted (see FIG. 4), electrical connections may be made and the warning illumination 29 installed. If the foregoing sequence is followed, usually a single person can accomplish the setup. Final to these actions, the guys, if required, are installed, as shown in FIGS. 2 and 3, and are adequately cinched.

Figure 3:
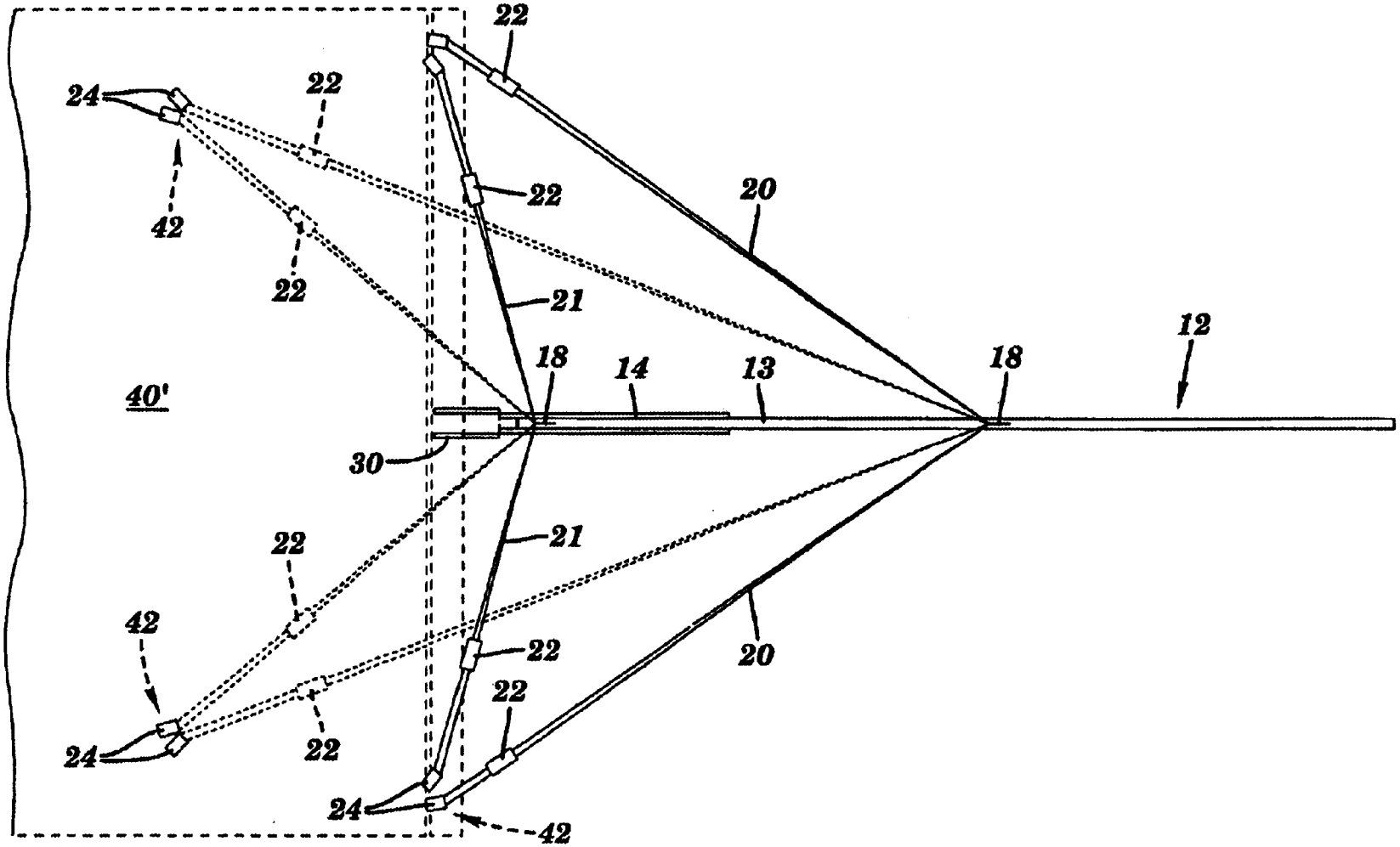
FIG. 3 is a plan view of the invention mounted to a flatbed vehicle.

Although shown sufficiently in FIGS. 1 and 2, the supporting network is illustrated in the plan drawing of FIG. 3. Here it can be seen that the longitudinal plane of the invention is aligned with the hitch 30 axis. The guys 20/21 pass through the D-rings 18, in this case. Using the pass-through feature will allow use of single shanking devices 22 and take little from the utility of the secondary supports. In this view, the vehicle's (flatbed) hard-points 42 are the bumper and tie-down cleats (not illustrated) on the bed. If the flatbed has stake holes, such may also be used.

Figure 4:
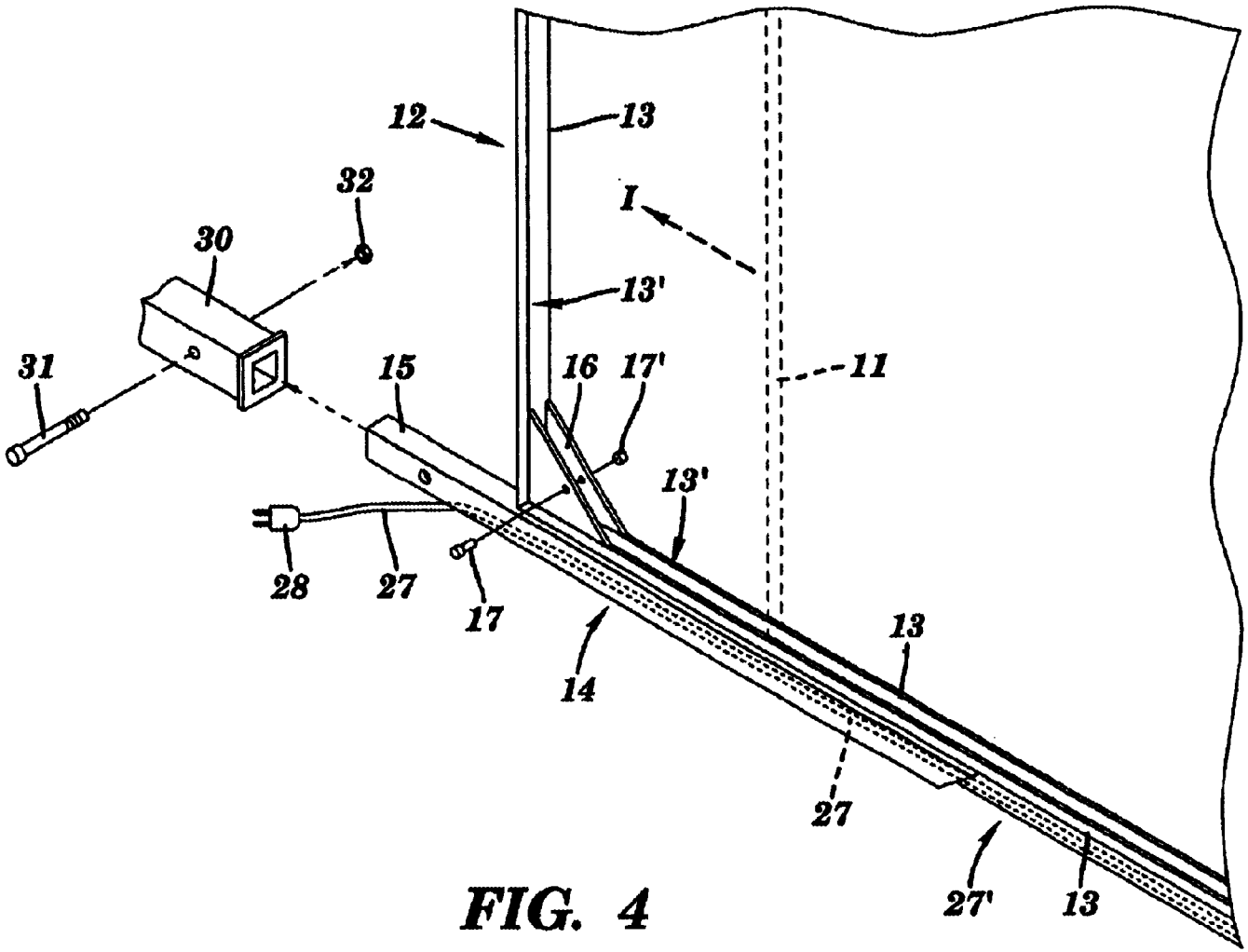
FIG. 4 is a partial perspective illustration of the main hitch-connecting feature of the invention.

FIG. 4 is a partial perspective illustration of the hitch-connecting feature and shows a few of the incidentals of my invention. Most prominently displayed is the strut 14 portion of the frame 12, with the tongue 15 poised for insertion into the sleeve of the hitch 30. The connection made by insertion is then secured by passing pin or bolt 31 through the aligned holes in the hitch and tongue and capturing the nut 32. A sign 11 is indicated, in phantom, with its direction of insertion I into the frame 12. Members 13 compose a channeled 13', welded steel article that is corner-braced 16 and welded to the strut 14. Wiring 27 runs under or through the strut and may be guided further rearward by conduit-shield 27'. Final to this detail is the placement of bolt-nut 17–17' in two or more of the corner braces 16, passing through margins of the sign, to secure it within the frame. If a frame consisting of only angle iron members is used, several marginal fixations of the sign will have to be made.

Figure 5:
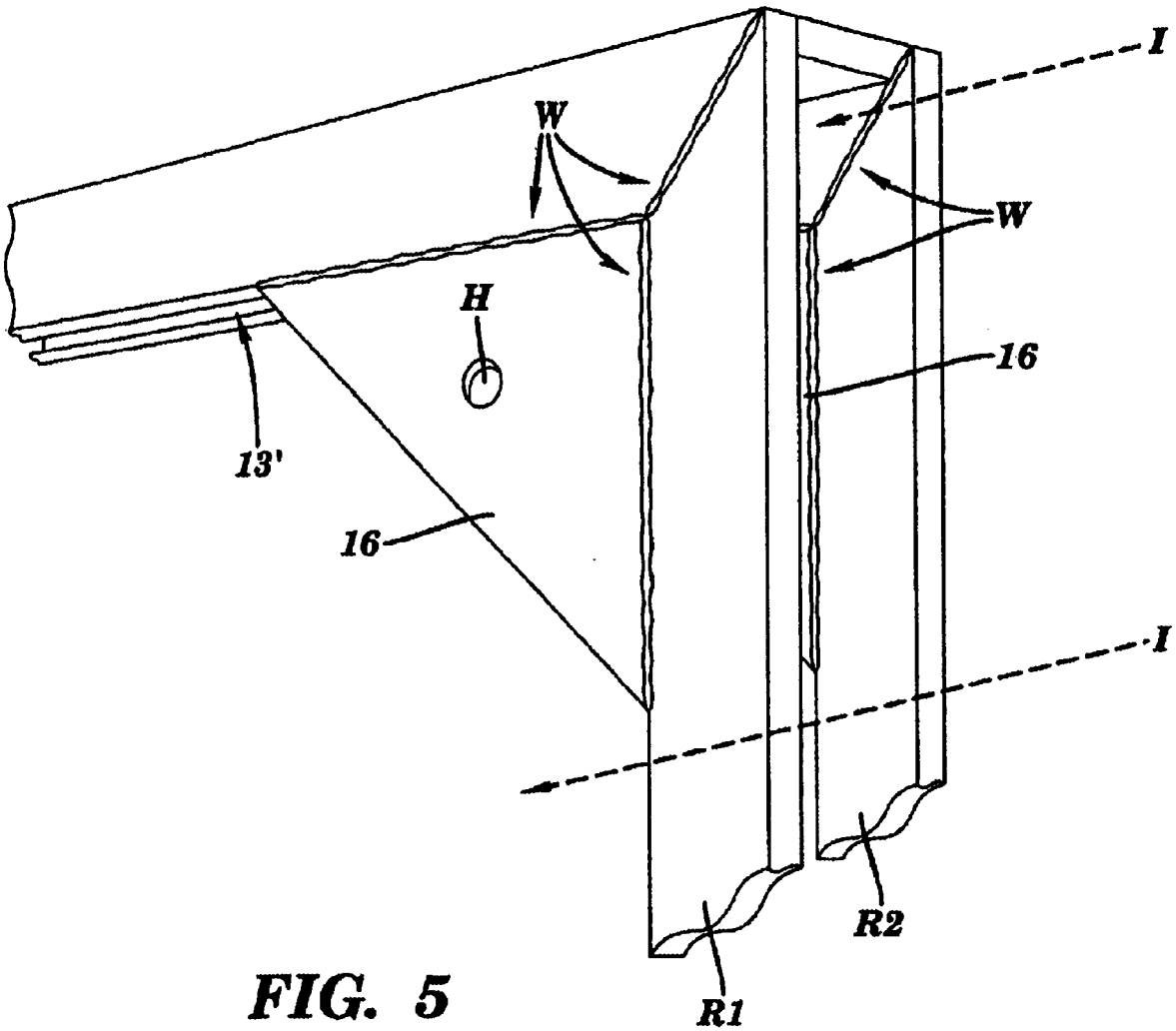
FIG. 5 is a perspective detail of the rear margin of the frame taken at 5—5 of FIG. 1.

FIG. 5 is a perspective detail of a rear corner margin of the frame taken at 5—5 of FIG. 1 and using the construction of FIG. 4. Here, at the rear (top) margin, a channel frame member 13' is replaced by two parallel rails RM,R2. Those of ordinary skill will recognize that this open (R1,R2) margin can be but a single rail (not expressly shown), welded W to the flanges of its adjacent frame members and employing devices such as the bolt-nut 17–17' (see FIG. 4) to fix the sign at hole(s) H. Note that, in this view, braces 16 are shown on both sides of the frame.

Many such details may be varied without departing from the spirit of the invention; for example: guy lines may be solid, inflexible brackets; clips may be substituted for nut-bolt devices; and, bolting frame pieces to a unitary tongue and base bracket may suffice for smaller signs. Most of these modifications or adaptations lie well within the skill of those routineers in the art. I therefore commend the principles of my invention, to the field, consistent with the hereinafter appended claims.

What is claimed is:

1. A sign holding display system configured for suspension from a fixed trailer hitch receiver in order to present information, in a profile view to pedestrian traffic, comprising: said trailer hitch receiver; a planar frame receptive therein of a sign; and, a tongue member projecting coextensively from a bottom margin of the frame, said tongue member being coaxially captived by said trailer hitch receiver to effect a cantilevered support of the frame and presentation of the sign in said profile view.

2. The system of claim 1 wherein the frame comprises at least three concatenated members and includes at least one tie point on an upper portion of the frame.

3. The system of claim 1 wherein said tongue member is shaped to fit into the receiver.

4. The system of claim 2 further comprising at least two guy lines, each secured at one end thereof to said at least one tie point and securable at a second end least two laterally opposite hard-points of a vehicle which bears the receiver.

5. The system of claim 3 further comprising a wiring harness for providing connection to an electrical power source and communicating electric power to the frame.

6. The system of claim 5 further comprising a warning subsystem disposed on and proximate a trailing edge of the frame.

7. The system of claim 5 further comprising a lighting subsystem disposed on the frame.

8. A trailer hitch-mountable, planar sign frame, having a partially tracked inner periphery and configured to secure within said periphery at least one planar sign, said frame characterized by:

a rigidly fixed trailer hitch receiver;

said frame formed by at least three concatenated members, the frame including at least one tie point on an upper margin thereof and at least one strut which projects coextensively from a bottom margin and that is within said plane of the frame, said strut being conformed to a tongue element at a free end thereof, said tongue element allowing part of the strut to be inserted into, and captured by, said trailer hitch receiver to effect a single cantilevered suspension of the frame, coaxial with the receiver and free of the ground, whereby said plane faces in a direction perpendicular to the strut.

9. The system of claim 8 wherein said tongue element is shaped to fit longitudinally into the receiver.

10. The system of claim 9 further comprising at least two guy lines, each secured at one end thereof to said at least one the point and securable at a second end thereof to at least two laterally opposite hard-points of a vehicle which bears the receiver.

11. The system of claim 9 further comprising a wiring harness for providing connection to an electrical power source on a vehicle and communicating electrical power to the frame.

12. The system of claim 11 further comprising a warning subsystem disposed on and near a trailing edge of the frame.

13. The system of claim 11 further comprising a lighting subsystem disposed on the frame.

14. A vehicle-mountable, planar sign frame, displaying indicia in profile to passing side traffic, and comprising:

at least three concatenated members, the frame including at least one tie point on an upper margin thereof, said frame receptive therein of a planar sign;

at least two guy lines, each secured at one end thereof to said at least one tie point and securable at a second end thereof to at least two laterally opposite tie-points of a vehicle to which is fixed a trailer hitch receiver; and at least one strut which projects from off at least one margin of, and within a plane formed by the frame and which is conformed to a tongue member at a free end thereof, said tongue member adapted to allow said free end of the at least one strut to be inserted into and captured coaxially by said hitch receiver, thereby aligning the plane of the frame coextensively with an axis of the receiver.

15. The system of claim 14 further comprising a wiring harness for providing connection to an electrical power source on a vehicle and communicating electric power to the frame.

16. The system of claim 15 further comprising a warning subsystem disposed on and proximate a trailing edge of the frame.

17. The system of claim 16 further comprising a lighting subsystem disposed on the frame.

* * * * *